US005823221A

United States Patent [19]

Stomp et al.

[11] Patent Number: 5,823,221

[45] Date of Patent: Oct. 20, 1998

[54] DEVICE AND METHOD FOR THE AUTOMATIC COUPLING OF A TEEMING LADLE TO ONE OR MORE GAS PIPES

[75] Inventors: Hubert Stomp, Luxembourg-Howald; Albert Feitler, Strassen, both of Luxembourg

[73] Assignee: Paul Wurth S.A., Luxembourg, Germany

[21] Appl. No.: 607,610

[22] Filed: Feb. 27, 1996

[30] Foreign Application Priority Data

Mar. 3, 1995 [LU] Luxembourg ..... 88594

[51] Int. Cl.[6] ..... F16L 55/18

[52] U.S. Cl. ..... 137/15; 137/238; 251/149.6; 251/149.7

[58] Field of Search ..... 137/238, 15; 251/149.6, 251/149.7

[56] References Cited

U.S. PATENT DOCUMENTS 3,703,908 11/1972 Tellier ..... 137/238
5,065,986 11/1991 Perri .

FOREIGN PATENT DOCUMENTS

A-0 320 841 6/1989 European Pat. Off. .
A-0 537 536 4/1993 European Pat. Off. .
2471880 6/1981 France ..... 251/149.6
A-41 17 588 12/1992 Germany .
A-87 868 12/1990 Luxembourg .

*Primary Examiner*—Denise L. Ferensic
*Assistant Examiner*—John Ball
*Attorney, Agent, or Firm*—Fishman, Dionne, Cantor & Colburn

[57] ABSTRACT

A coupling device for the automatic coupling of a teeming ladle to several gas pipes is presented. The coupling device comprises a first coupling part connected to a gas supply and a second coupling part attached to the teeming ladle, with several gas outlets being arranged in the first coupling part and several gas inlets being arranged in the second coupling part. Each individual gas outlet can be closed by a closing element in the first coupling part, wherein, when being coupled to the second coupling part, this closing element is pressed inwards into the first coupling part and opens the corresponding gas outlet. To bring about self-cleaning of the coupling parts before they are coupled together, the closing elements are designed in such a way that, when the two parts of the coupling are coupled together, before the sealing union of the two coupling parts, a single gas outlet is first opened, before the other gas outlets are opened.

25 Claims, 8 Drawing Sheets

DEVICE AND METHOD FOR THE AUTOMATIC COUPLING OF A TEEMING LADLE TO ONE OR MORE GAS PIPES

BACKGROUND OF THE INVENTION

The present invention relates to a device and method for the automatic coupling of a teeming ladle to one or more gas pipes.

On completion of the melting operation, the molten metal is run off from the melting vessel into metallurgical vessels suitable for transportation and casting. The molten metal is often treated in these teeming ladles to modify its chemical composition. To do so, the liquid metal is flushed or stirred with gases, which are blown into the ladle through a porous plug or area in the bottom of the ladle. The transformation products rise to the surface of the melt and are there absorbed by the slag.

For this treatment purpose, the teeming ladle is inserted into a receptacle, where it is connected to the gas supply pipes. This connection of the gas supply pipes should as far as possible take place automatically, since, in view of the environment, the risk of accident and injury to the operator for manual connection is very high.

Automatic couplings are known in the prior art to enable the teeming ladle to be connected to one or two gas supply pipes. For example, Patent EP-A-0,320,841 describes a device for connecting a teeming ladle to a gas pipe, wherein a valve centrally arranged in the lower coupling part opens automatically when the two parts of the coupling are brought together.

Luxembourg Patent LU-87 868 describes a device with a tandem valve, which permits the simultaneous coupling of the teeming ladle to two different gas supply pipes. A first central outlet for the first gas is provided in the lower coupling part. The second gas is guided by several component outlets distributed in a circle round this central inlet. In the upper part, the corresponding inlets are similarly distributed, wherein an annular seal is arranged between the central inlet and the component inlets distributed round it, thereby preventing the two gases from mixing when the device is coupled together. Outside, round the component inlets, runs a further seal, which seals off the transitions between the parts radially outwards. In a severe environment, like that produced in the metallurgical industry by dust and heat, the known prior art devices exhibit the disadvantage that, when the device is uncoupled, the lower coupling part attached to the receptacle is exposed to the impurities in the environment. These impurities are deposited on the surface of the coupling part, in time leading to the coupling device no longer sealing properly, since the seals provided no longer rest properly on the sealing surfaces. In addition, the deposited impurities cause blockages to gas inlets and gas outlets.

The problem to be solved by the present invention is, therefore, to provide a coupling device for a plurality of gases which is largely self-cleaning. According to the present invention, this problem is solved by a device for automatically coupling a teeming ladle to one or more gas pipes, comprising a first coupling part connected to a gas supply, and a second coupling part attached to the teeming ladle, wherein a plurality of gas outlets are arranged in the first coupling part, and one or more gas inlets are arranged in the second coupling part. Each individual gas outlet can be closed by an associated closing element in the first coupling part, wherein this closing element, when being coupled to the second coupling part for example, is pressed inwards into the first coupling part and opens the corresponding gas outlet. The closing unit according to the invention is characterized in particular by the fact that these closing elements are designed in such a way that, when the two parts of the coupling are coupled together, but before the sealing mating of the two coupling parts, a single gas outlet is opened, before the other gas outlets are opened.

The early opening of one of the closing elements produces a gas flow from the open gas outlet, flowing radially outwards from the gas outlet, through the gap between the first and second coupling elements. Since the gas supply pipes are under a high pressure, and the gap between the two coupling elements is quite small when the single gas outlet opens, the velocity of the gas flow is correspondingly high, so that impurities which have been deposited on the surface of the coupling elements are blown off the coupling surfaces. Since this occurs every time a teeming ladle is coupled up, i.e. at short intervals, no incrustation of the deposits takes place, so that they remain powdery and are carried away by the gas flow.

It should be noted that the opening of initially only one of the gas outlets plays an important role. In fact, if all the gas outlets arranged in a circle round the axis are opened simultaneously, turbulence occurs in the middle between the outlets. The impurities stirred up therein are not blown out of the space between the two parts of the coupling, but are deposited on the first coupling part when coupling takes place. Consequently, the two parts of the coupling can no longer mate in such a way that the surfaces are in contact with each other, and the coupling device becomes leaky.

When the two parts of the coupling are disconnected, this characteristic also has a beneficial effect. In this instance, the two parts of the coupling are first of all parted until there is no longer a sealed joint. The gas outlets are still open. The gas flowing through the individual gas outlets cleans the impurities from them and flushes the impurities into the space between the two parts of the coupling. When the two parts of the coupling are moved further apart, all the gas outlets but one are closed, whereby the impurities situated between the two parts of the coupling are carried radially outwards. Only then are the two parts of the coupling far enough apart for the last gas outlet to close. This prevents impurities from getting into the gas outlets and becoming stuck there.

In one possible embodiment, there is one gas outlet more in the first coupling part than there are gas inlets in the second coupling part, and the closing elements are designed in such a way that, when coupling together the two coupling parts, the gas outlet to which no corresponding gas inlet has been assigned is opened first, before the other gas outlets are opened. This one gas outlet can then, for example, be arranged on the axis of the coupling device.

In a preferred embodiment, the gas outlets are made conical and can be positively closed by a conical closing element, wherein the conical closing element is arranged to be axially displaceable in the first coupling part and, in the closed position, projects from the conical gas outlet in such a way that, when coupling, it is pressed inwards by the second coupling part.

By virtue of the conical shape of the gas outlets and the closing elements, when the gas outlet is closed, it is positively closed. At the boundary between the surface of the coupling part and the surface of the closing element, no deep grooves, in which impurities tend to settle, are formed. Penetration of impurities into the gas outlet is thereby prevented.

Moreover, by virtue of the conical shape of the two elements, when the closing element is pressed into the first coupling part, the gap between the closing element and the gas outlet increases as the closing element is pressed further into the coupling part. Consequently, impurities which penetrate into the gap formed when the gas inlet is opened cannot settle there, but are conveyed away from the gas inlet by the gas flow.

Each of the closing elements is preferably axially displaceable in the corresponding gas outlet against an elastic means, for an example a helical spring, wherein, when the device is uncoupled, the elastic means presses the closing element tightly against the conical gas outlet.

Each of the conical closing elements preferably has an annular shoulder surface, in which an annular soft seal is fitted in such a way that the annular soft seal rests tightly on an annular seating surface surrounding the conical gas outlet when the conical closing element is positively seated in the conical gas outlet.

A double seal of the gas inlets is thereby achieved. The gas inlets are reliably sealed by the positive seal and by the annular seal when the device is uncoupled, thereby rendering a further shut-off device for the gas pipes unnecessary.

Also advantageous is a device in which the first part of the coupling is in the form of a cone and the second part of the coupling is in the form of a conical dish which can be slid onto this cone, wherein the opening angle of the dish is greater than the opening angle of the first coupling part.

By virtue of this conical shape, the two parts of the coupling are automatically centered when coupling them together, whereby the gas outlets and gas inlets are exactly axially opposite each other after coupling.

Since the opening angle of the conical dish is greater than the opening angle of the first coupling part, the space between the two parts of the coupling increases radially outwards. Blowing out the impurities when the first gas inlet is opened is thereby facilitated, since the impurities cannot settle on the way out.

In a preferred embodiment, the cone of the first part of the coupling has a spherical tip, and the bottom of the conical dish of the second coupling part is designed to be complimentarily spherical in order to rest on the spherical tip of the first coupling part. This spherical design of the two mating parts allows for compensation for tilting of the teeming ladle in relation to the perpendicular, but nevertheless ensures a positive seating of the second part of the coupling on the first. If, moreover, the gas outlets are arranged in the conical tip of the gas inlets in the spherical dish, tilting of the teeming ladle can be compensated for without the transitions between the gas outlets and the gas inlets becoming leaky.

In a preferred embodiment of the invention, the second part of the coupling comprises a coupling sleeve and a coupling body, wherein the coupling body is mounted axially displaceable in the coupling sleeve, and elastic means are provided, for example a helical spring, in order to support the coupling body against a ledge in the coupling sleeve, so that, when the device is uncoupled, the coupling body is in an advanced position, and, when the device is coupled together, the coupling body is pressed into the coupling sleeve against the spring force of the elastic means, so that the coupling body is pressed by the spring force of the means tightly, producing a seal, against the surface of the first part of the coupling.

By virtue of the pretensioning of the spring means, when coupling to the first part of the coupling, the coupling body is first of all pressed against the surface of the first part of the coupling by the spring force of the elastic means. The coupling body is then axially displaced into the coupling sleeve. In contrast to a single-part design of the second part of the coupling, the impact when the two parts of the coupling meet is thereby cushioned, whereby the device as a whole is protected against shocks.

In order further to increase the contact pressure of the two parts of the coupling and thereby to improve the sealing of the transitions between the gas outlets and the gas inlets, one of the inlets in the second part of the coupling is preferably connected to a chamber above the coupling body, so that, when the device is coupled together, the gas pressure generated in the chamber exerts a force on the coupling body, acting in the coupling direction, thereby increasing the contact pressure of the annular seals at the surface of the first part of the coupling.

In fact, even when the gas is in its turn led from the chamber into the teeming ladle, an excess pressure is generated in this chamber by the high resistance to the gas flow from the porous area of the ladle, so that the coupling sleeve interacts with the coupling body like a pressure cylinder. This pressure cylinder acts in the same direction as the elastic means, so that the elastic element is supported in its function by the pressure cylinder.

For production engineering reasons, each gas inlet is preferably formed as an insert which can be screwed into the second part of the coupling, an annular seal being incorporated in said insert. It is to be noted that in a device with several gas inlets, the gas inlets are not arranged on the axis of the coupling device. This means, however, that, for example with a conically formed dish, an annular seal being fitted in a groove, e.g. a swallow-tail groove, round the gas inlet, no longer lies in a flat plane perpendicular to the axis of the coupling body, but is curved over the cone surface. This groove can therefore no longer be turned from the coupling body, but has to be produced by another and more complicated method. To resolve this problem, the insert is screwed in at an angle into a fixture, in such a way that a middle plane through the groove being turned is perpendicular to the axis of the holder. The fixture can then be turned on a lathe, and the requisite groove be machined.

In a preferred embodiment, each inlet in the insert consists of several holes which are arranged in a circle round the point of impact of the corresponding closing element. The point of impact for the closing element is consequently formed by the surface between the individual holes, which prevents the gas inlet from being closed by the tip of the closing element.

In a further preferred embodiment, in which there is one gas outlet more in the first part of the coupling than there are gas inlets in the second part of the coupling, and the closing elements are designed in such a way that, when the two parts of the coupling are being coupled together, the gas outlet for which there is no corresponding gas inlet is opened first, before the other gas outlets are opened. A closing element is axially displaceable in the gas outlet for which there is no corresponding gas inlet, in such a way that, when the device is filly uncoupled or filly coupled together, this gas outlet is closed, and is opened during the coupling process. For this purpose, an insert having an axial hole can be located in the gas outlet and the closing element can be in a cylindrical shape and have two end sections and a narrower middle section, wherein the diameter of the hole in the insert is selected so that the end sections of the closing element can be displaced therein with a precise fit.

Preferably, a radial seal is fitted in the hole in the insert in such a way that the gas outlet is sealed by the closing element when the closing element is located in a position in which one of the two end sections is resting on the radial seal, and the gas outlet is opened when the closing element is situated in a position in which the narrow middle section of the closing element is situated level with the radial seal, which occurs during the coupling and uncoupling operations.

In order additionally to seal the closing element when the device is uncoupled, the cylindrical closing element can, for example, have an annular shoulder surface in which an annular soft seal is fitted in such a way that the annular soft seal rests tightly on an annular seating surface surrounding the hole in the insert when the cylindrical closing element projects completely out of the cylindrical gas outlet. In one preferred embodiment, the closing element is axially displaceable in the gas outlet against an elastic means, for example a helical spring, wherein, when the device is uncoupled, the elastic means displaces the closing element in the gas outlet in such a way that the annular shoulder surface is pressed tightly against the annular seating surface of the insert. Furthermore, in a preferred embodiment, the gas outlet for which there is no corresponding gas inlet is connected via a connecting pipe to the gas supply of one of the other gas outlets.

This invention also relates to a method for the automatic coupling of a device to several gas pipes, wherein a first coupling part, connected to a gas supply, and a second coupling part, connected to the device, are coupled together, and wherein several closable gas outlets are arranged in the first coupling part and one or more gas inlets are arranged in the second coupling part, and which is characterized by the steps:

axial bringing together the first and second coupling parts;

opening of a first gas outlet in the first coupling part before the two coupling parts are brought together;

opening of the remaining gas outlets in the first coupling part after the coupling surfaces have been cleaned by the gas flowing out of the open gas outlet, wherein impurities which have been deposited on the coupling surfaces are flushed radially outwards by the gas flow;

sealing union of the two coupling parts;

sealing of the individual connections between the respective gas outlets and the corresponding gas inlets.

BRIEF DESCRIPTION OF THE DRAWINGS

Preferred embodiments of the invention will now be described by reference to the Figures, which show.

DESCRIPTION OF THE PREFERRED EMBODIMENTS

Figure 1:
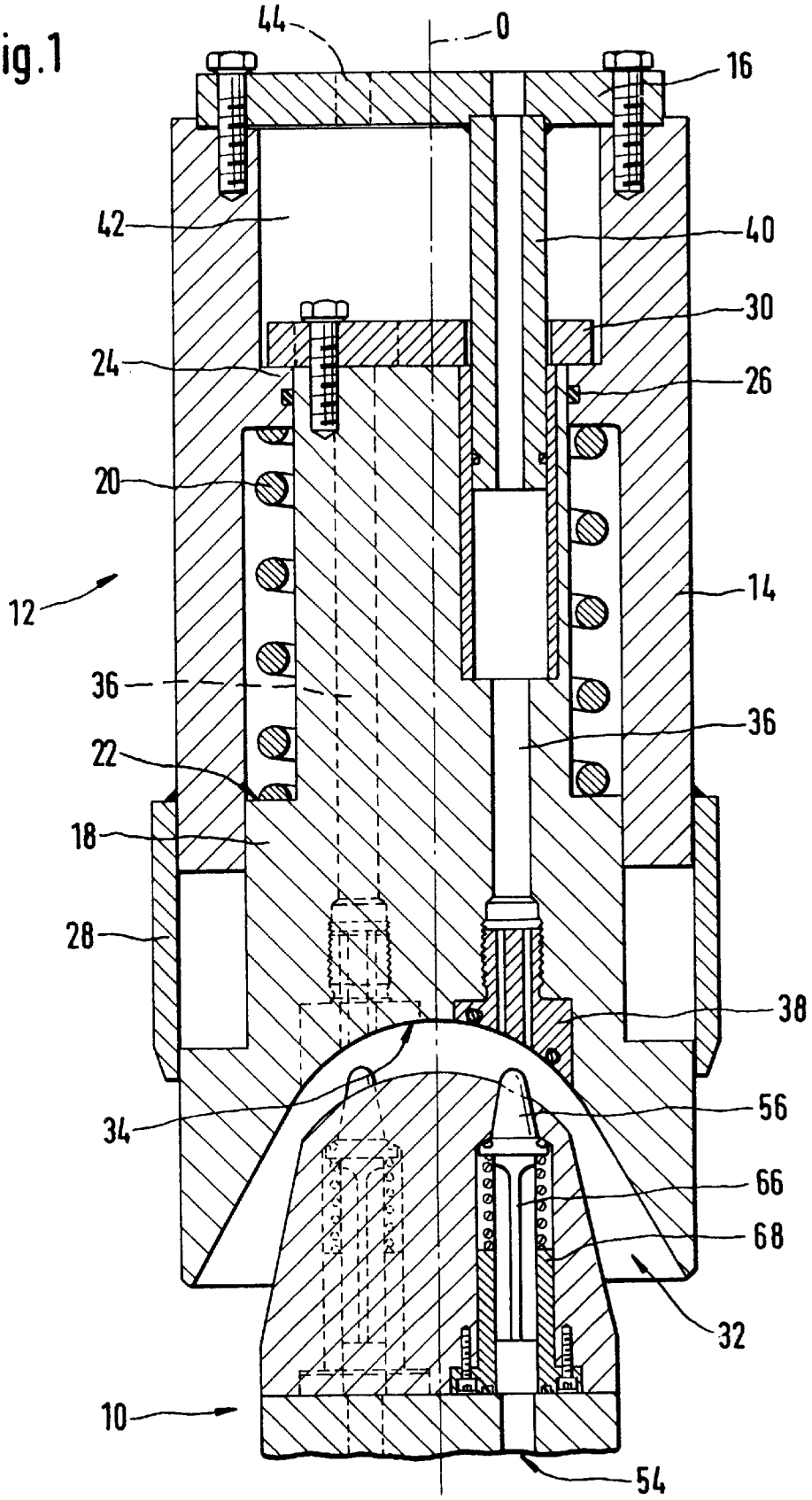
FIG. 1 is a vertical section through a coupling device according to the invention, for the simultaneous coupling of a teeming ladle to three different gas pipes, wherein the two parts of the coupling are shown in their uncoupled position.
Figure 2:
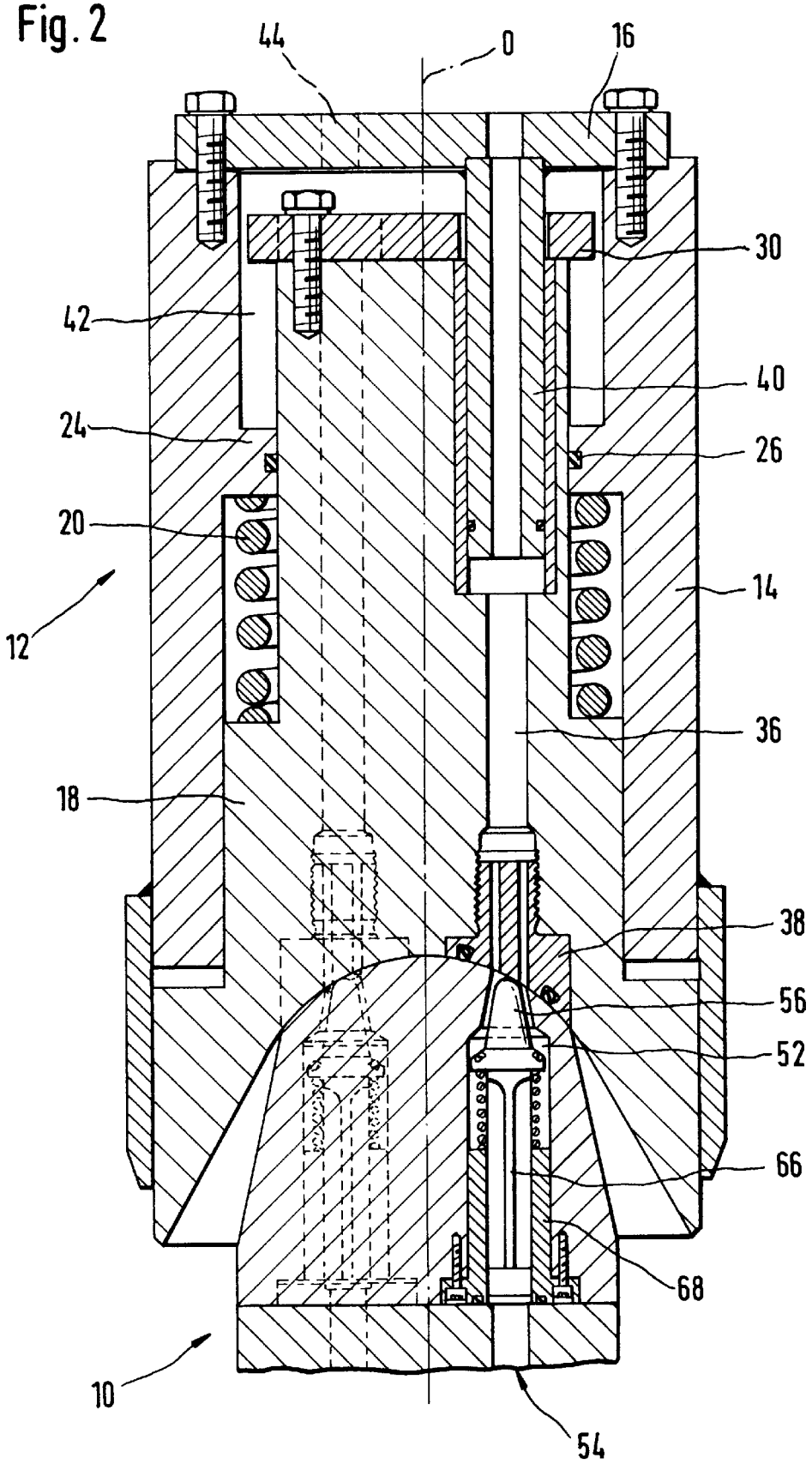
FIG. 2 is a vertical section through the coupling device in FIG. 1, wherein the two parts of the coupling are shown in their coupled position.
Figure 3:
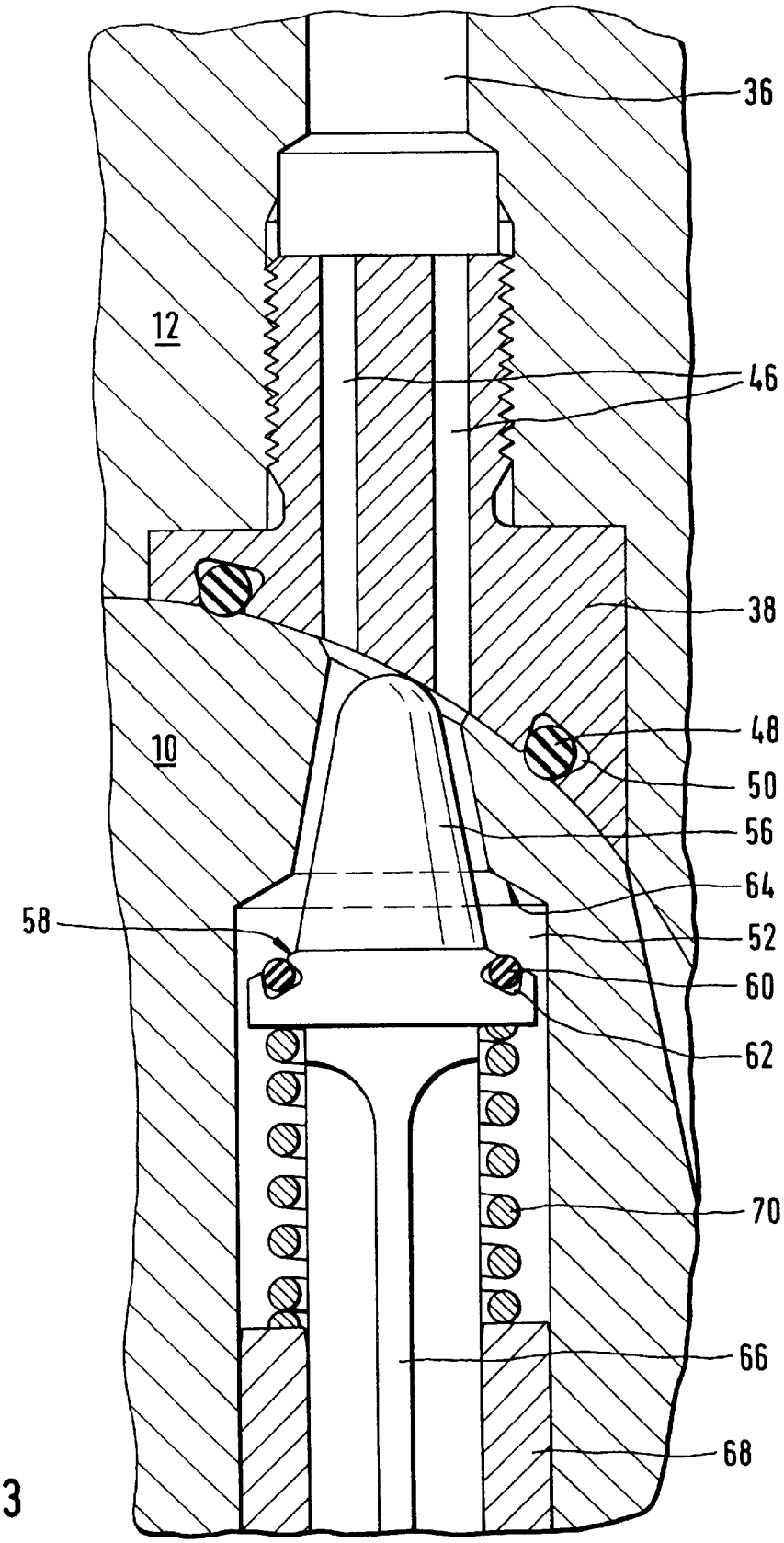
FIG. 3 is a detail from FIG. 2, showing enlarged the valve in the first coupling part and the inlet arranged above it with the component inlets into the second coupling part.

In FIG. 1 and FIG. 2, a coupling device according to the invention is shown, while FIG. 3 shows an enlarged detail of this coupling device. The coupling device consists of a lower (first) coupling part 10 and an upper, second coupling part 12. The second coupling part 12 is preferably permanently connected to the teeming ladle, while the first coupling part 10 is connected to the gas supply pipes and is arranged in the receptacle for the teeming ladle in such a way that it can be displaced in two directions at right angles to each other in a plane perpendicular to a 0 axis through the coupling device. Inaccuracies in the axial alignment of the upper coupling part attached to the teeming ladle above the lower coupling part can thereby be compensated.

The second coupling part 12 consists of a coupling sleeve 14, closed at the top by a cover 16, and a coupling body 18 arranged axially displaceable within sleeve 10. Coupling body 18 preferably has three coaxial cylindrical sections with three different diameters, wherein the diameter of the upper section is the smallest and the diameter of the lower section is the largest. A helical spring 20 is fitted around and coaxial with the upper section of coupling body 18, and spring 20 rests at the bottom on a shoulder or projection 22 on the coupling body 18 formed by the first increase in diameter. At the top, the spring 20 rests against a ledge 24 in the coupling sleeve 14. The upper section of the coupling body 18 is guided by the inner diameter of ledge 24 and is sealed by an annular seal 26 in ledge 24, while the middle section of coupling body 18 is guided by the inner diameter of coupling sleeve 14. The lower section of the coupling body 18 fits displaceably in a sleeve 28 attached to the lower part of coupling sleeve 14. Sleeve 28 essentially has a protective function and prevents the ingress of impurities between the coupling sleeve 14 and the middle section of the coupling body 18.

Under the influence of the helical spring 20, the coupling body 18 is pressed axially downwards. To prevent the coupling body 18 from falling out of the coupling sleeve 14, a stop plate 30 of larger diameter than the upper part of coupling body 78, is screwed at the top to the upper section of coupling body 18, and stop plate 30 contacts the top surface of ledge 24 to limit the downward motion of coupling body 18.

At the lower end of coupling body 18, a conical dish 32 is machined, the "bottom" 34 of which is preferably spherically rounded off. In addition, three gas passages 36 are formed in and through the axial length of coupling body 18, parallel to the 0 axis, each of said gas passages widening out its lower end, the wider part being provided internally with a thread and into which an insert 38 with the gas inlets can be screwed. Only two of the gas passages 36 can be seen in FIG. 2. FIG. 3 shows the arrangement of the three gas passages space 120° apart around axis 0. At the top of coupling body 18, two of the three gas passages 36 run via a telescopic connecting piece 40 through cover 16, from where pipes (not shown) lead to the porous area of the teeming ladle. The third gas passage feeds into a chamber 42 formed inside the coupling sleeve 14 between the cover 16 and the stop plate 30. Chamber 42 in turn is connected, through a hole 44 in the cover 16, via a pipe to the porous area of the bottom of the teeming ladle.

Figure 4:
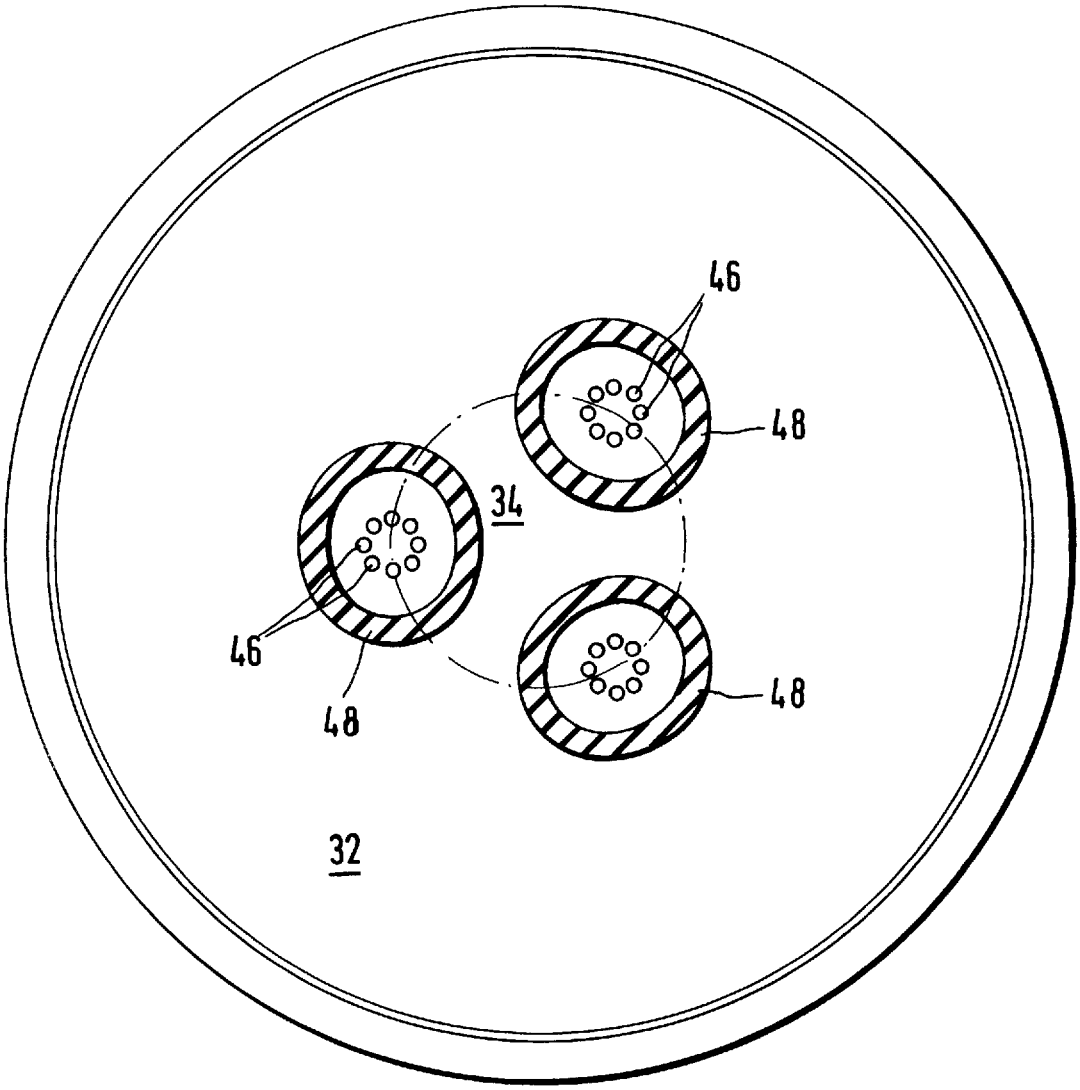
FIG. 4 is a view from underneath of the conical dish of the second coupling part.

It can be seen from FIG. 3 and FIG. 4 that each insert 38 has several passages 46 arranged in a circle round the axis of each respective gas passage 36. Round these holes 46, at the lower end of the inserts 38, an annular seal 48 is arranged in a swallow-tail groove 50. When the parts of the coupling are coupled together, seal 48 seals, radially outwards, the transition between the gas outlets in the first part of the coupling and the gas inlets in the second part of the coupling.

The first coupling part 10 is generally conical, either the upper part being spherically rounded off to match the "bottom" 34 of dish 32 on the second coupling part. First coupling part 10 has three gas outlets 52 (see FIG. 3) which, when the parts of the coupling are placed together, are axially opposite the gas passages 36 in the second coupling part. At the bottom, the gas outlets 52 are connected to gas supply pipes 54 (FIG. 1 and FIG. 2), via which the various flushing gases are delivered. In their upper part, the gas outlets 52 are of a conical shape and can be positively closed by an automatically operated closing element 56.

Lower down, each of the closing elements 56 has an annular shoulder 58, in which an annular soft seal 60 is fitted in a swallow-tail groove 62. This seal 60 rests on an annular seating surface 64, which surrounds the conical gas outlet 52 and additionally seals off the gas outlet when the conical closing element 56 is positively seated in the upper part of conical gas outlet 52.

The closing elements 56 are extended downwards by guide elements 66, which have a cross-shaped horizontal cross-section and which guide the closing arrangement tilt-free in a sleeve 68 fitted in the gas outlets 52. A helical spring 70 is arranged around and coaxially with each of the guide elements 66. Spring 70 is supported at the bottom against the sleeve 68 and at the top against the closing element 56, whereby, in an uncoupled state, closing element 56 is pressed tightly against the corresponding gas outlet 52 to seal off the gas outlet.

The closing elements 56 are designed in such a way that, when the parts of the coupling are uncoupled, i.e. when the closing elements 56 are positively seated in the gas outlet 52 and the shoulders 58 are pressed against their seats 64, the tips of the closing elements 56 project from and beyond the surface of the first part of the coupling; and one of the closing elements 56 is formed to project further from the first coupling part than the other two. This is preferably the closing element which, when the device is coupled together, lies in the axial extension of the gas inlet of the second coupling part that is connected to the chamber 42.

In FIG. 1, the coupling device is shown in an uncoupled state. In this state the coupling body 18 is pressed to its downwards-most position by the helical spring 20 in the coupling sleeve 14, with stop plate 30 limiting the downward motion to retain coupling body 18 within the second coupling part. In the first coupling part, under the influence of the helical springs 70 and of the gas pressure acting from below, the closing elements 56 are positively pressed against their gas outlets, thereby preventing an outflow of gas delivered by the supply pipes 54.

If the two parts of the coupling are brought closer together by lowering the teeming ladle to effect coupling, first of all the closing element projecting furthest from the lower part of the coupling comes up against the insert 38 lying opposite it and is pressed into the first part of the coupling against the compression force of the spring 70 and is opened. This takes place before the annular seal 48 in the inlet 36 comes into contact with the outer surface of the first part of the coupling, and a gap exists between the first and second coupling parts at this stage of the closure movement. The gas flowing upward from the open gas outlet 52 is deflected at the "bottom" 34 of the dish 32 and then flows radially in all directions through the gap formed between the second and the first parts of the coupling at this stage of closure movement. Since the gas supply pipes 54 are under high pressure, and the gap between the two coupling elements is quite small when the first closing element 56 is opened, the velocity of the gas flow is correspondingly high, so that impurities, such as dust for example, which have been deposited on the surface of the coupling elements, are blown away outwards from the coupling surfaces. Since this occurs at each coupling of a teeming ladle, i.e. at short intervals, incrustation of the deposits does not occur, so that they remain powdery and are removed by the gas flow.

It should be noted that the initial opening of just one of the gas outlets plays an important role. In fact, if all the gas outlets arranged in a circle round the axis are opened simultaneously, turbulence will be produced in the middle between the outlets. The impurities stirred up therein will not be blown out of the space between the two parts of the coupling, but will be deposited on the first part 10 of the coupling when coupling takes place. The two parts of the coupling will not be able to come together so that the annular seals 48 rest on the surface of the first coupling part 10, and the coupling device becomes leaky.

As the two parts of the coupling are brought closer together, the other two closing elements open and their respective annular seals 48 rest on the surface of the first part of the coupling. This is shown in FIG. 2 and FIG. 3. The rounded-off tip of the lower cone and the rounded-off "bottom" of the upper dish permit the compensation of moderate tilting of the two parts of the coupling in relation to each other. When the surface of the first coupling part is resting firmly in the dish of the second coupling part, the coupling body 18 is pressed upwards into the coupling sleeve 14 against the spring force of the helical spring 20. Counteracting this, each seal 48 is pressed with the same spring force against the surface of the first part of the coupling. The transitions between the gas outlets 52 in the first coupling part and the gas inlets 32 in the second coupling part are thereby sealed off radially outwards.

Since the gas arriving at one of the gas inlets is first of all delivered to the chamber 42, before being conducted to the porous area of the teeming ladle, the pressure of the seals 48 on the surface of the first part 10 of the coupling is also increased. Since the porous area of the teeming ladle presents a high resistance to the inflowing gas, an excess pressure actually builds up in the chamber 42. This excess pressure exerts an additional force on the downward body 18, acting in the coupling direction, which is added to the spring force of the helical spring 20.

Opening the closing elements 56 reveals the advantage of their conical shape, compared with closing elements of cylindrical shape. In fact, the gap between the conical closing element 56 and its seating becomes greater as the closing element is pushed more deeply into coupling part 10. This prevents the gap from being blocked by dust or other impurities, since these cannot settle in the gap.

Figure 5:
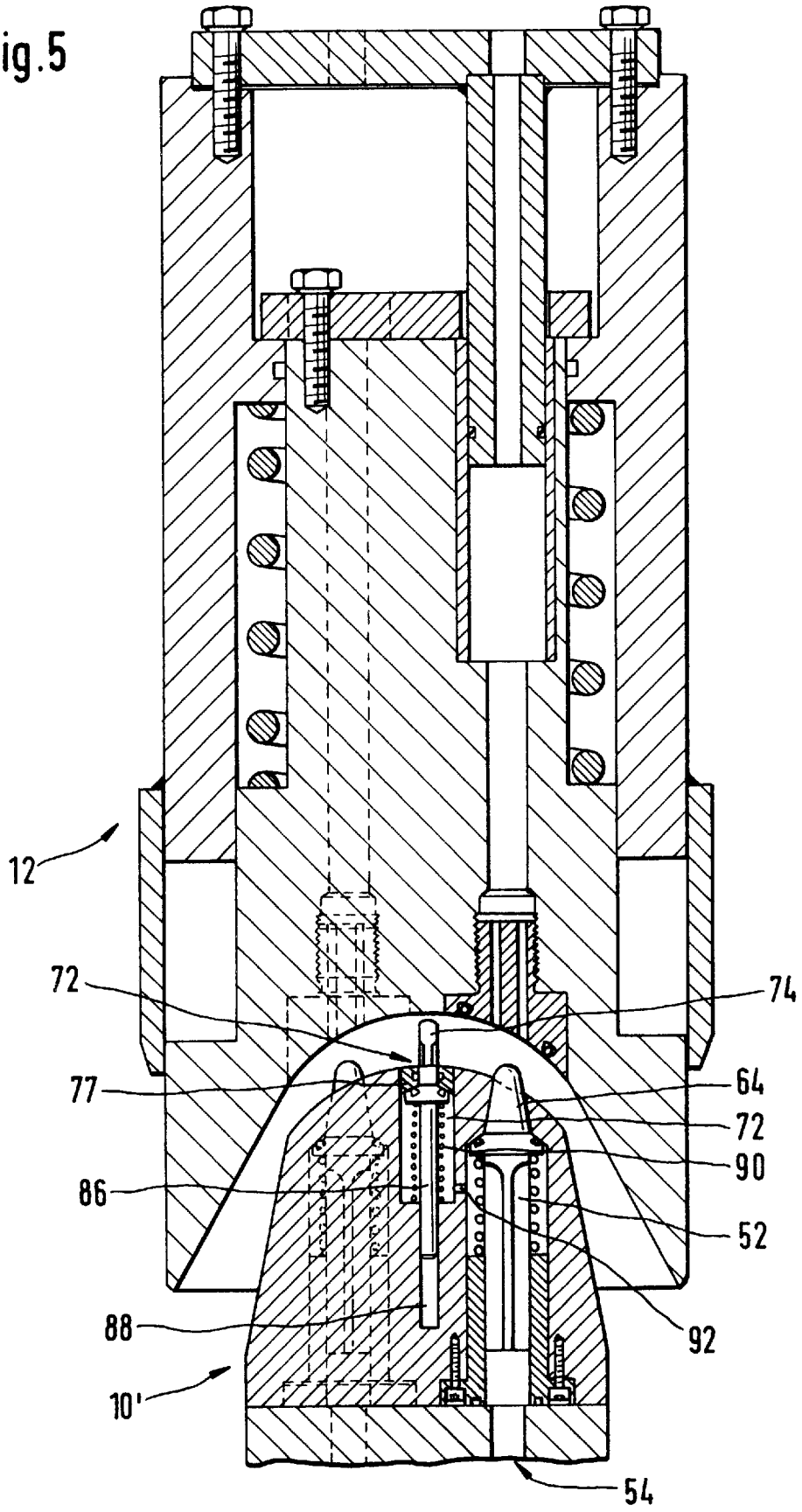
FIG. 5 is a vertical section through a further preferred embodiment of the coupling device according to the invention, for the simultaneous coupling of a teeming ladle to three different gas pipes, wherein the two coupling parts are shown in their uncoupled position.
Figure 6:
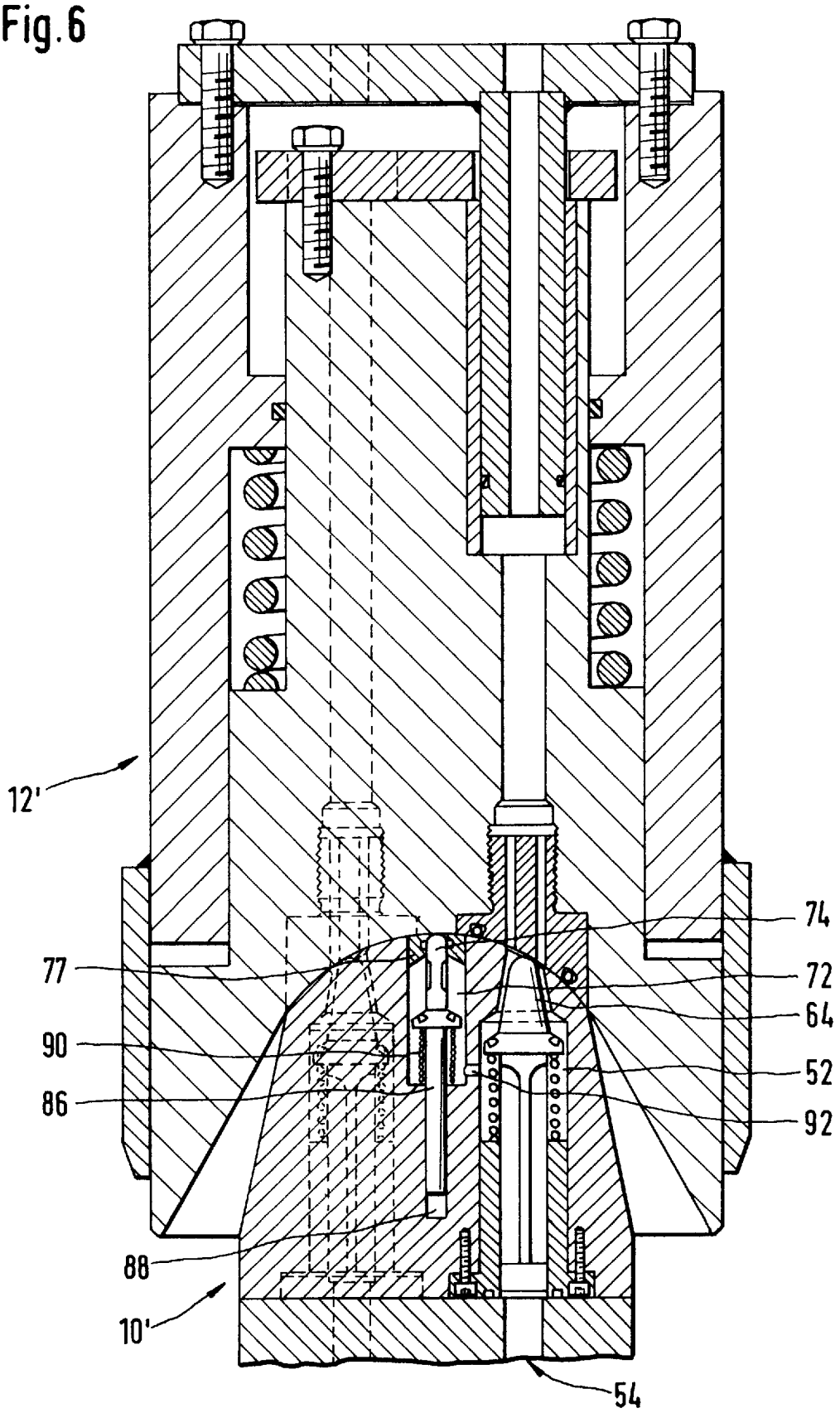
FIG. 6 is a vertical section through the coupling device in FIG. 5, wherein the two coupling parts are shown in the coupled position.

After the gas treatment, the teeming ladle is lifted out of the receptacle, wherein each closing element 56 is automatically closed and sealed under the spring force of its helical spring 70. In FIG. 5 and FIG. 6, a further preferred embodiment of the coupling device according to the invention is shown. In the first part 10' of the coupling, an additional gas outlet 72 is located, arranged on the 0 axis of the coupling device. There is no gas inlet opposite outlet 72 in the second part 12' of the coupling, so that the gas outlet 72 performs only the function of cleaning impurities away from the surfaces of the two parts of the coupling on closing.

For this purpose, the gas outlet 72 is equipped with a closing element 74 (see also FIG. 7) which is axially displaceable in the gas outlet, closing element 74 closing the gas outlet 72 (FIG. 7*c*) when the device is uncoupled, opening the gas outlet (FIG. 7*b*) for a certain time during coupling, and again sealing the gas outlet 72 after the two parts of the coupling have been brought together. In this instance, the closing element 74 protrudes beyond closure elements 56 so that it opens gas outlet 72 before gas outlets 52 open during the coupling operation.

In order to achieve this, the closing element 75 is designed to be cylindrical, wherein the middle section 76 has a smaller diameter than the two end sections. At its upper end, the gas outlet 72 is provided with an insert 77, in which a cylindrical passage is located, whose inside diameter is chosen so that the end sections of the closing element 74 can be inserted therein with an exact fit. In the insert 77, near to the upper end, a radial seal 78 is arranged in a groove round the hole, said radial seal 78 being able to seal off the gas outlet 72 at the upper and lower end sections of the closing element 74 (FIG. 7*a,c*). If the closing element is in an intermediate position, i.e. when the narrower middle section 76 is level with the radial seal 78 (FIG. 7*b*), the gas can flow between the narrower middle section 76 of the closing element 74 and the radial seal 78, and the gas outlet is opened.

Lower down, the closing element 74 has an annular shoulder 80, in which an annular soft seal 82 is fitted in a swallow-tail groove. This seal 82 rests on an annular seating surface 84, which surrounds the passage in the insert 77 and additionally seals the gas outlet when the closing element 74 is in its upper position, sealing the gas outlet 72 (FIG. 7*c*).

At the bottom, the closing element 74 is extended by a guide element 86, which guides the closing movement tiltfree in a closed end passage 88 in the bottom of the gas outlet 72. A helical spring 90 is fitted coaxially with the guide element 86. Spring 90 is supported at the bottom end against the bottom of the gas inlet and at the top against the closing element 74, wherein, in an uncoupled state, element 74 is pressed with its shoulder 80 and O ring 82 tightly against the annular seating surface 84.

Since gas outlet 72 performs only the function of cleaning impurities from the surfaces of the two parts of the coupling, there is no need for it to be connected to its own gas supply 54. For this reason, gas outlet 72 is connected via a connecting pipe 92 to an adjoining gas outlet 52, so that, when gas outlet 72 is opened, the gas flows from the gas supply 54 of the adjoining gas outlet 52, through the connecting pipe 92, to the opened gas outlet 72, and there escapes through the gap between the narrower middle section 76 of the closing element 74 and the radial seal 78.

Figure 7:
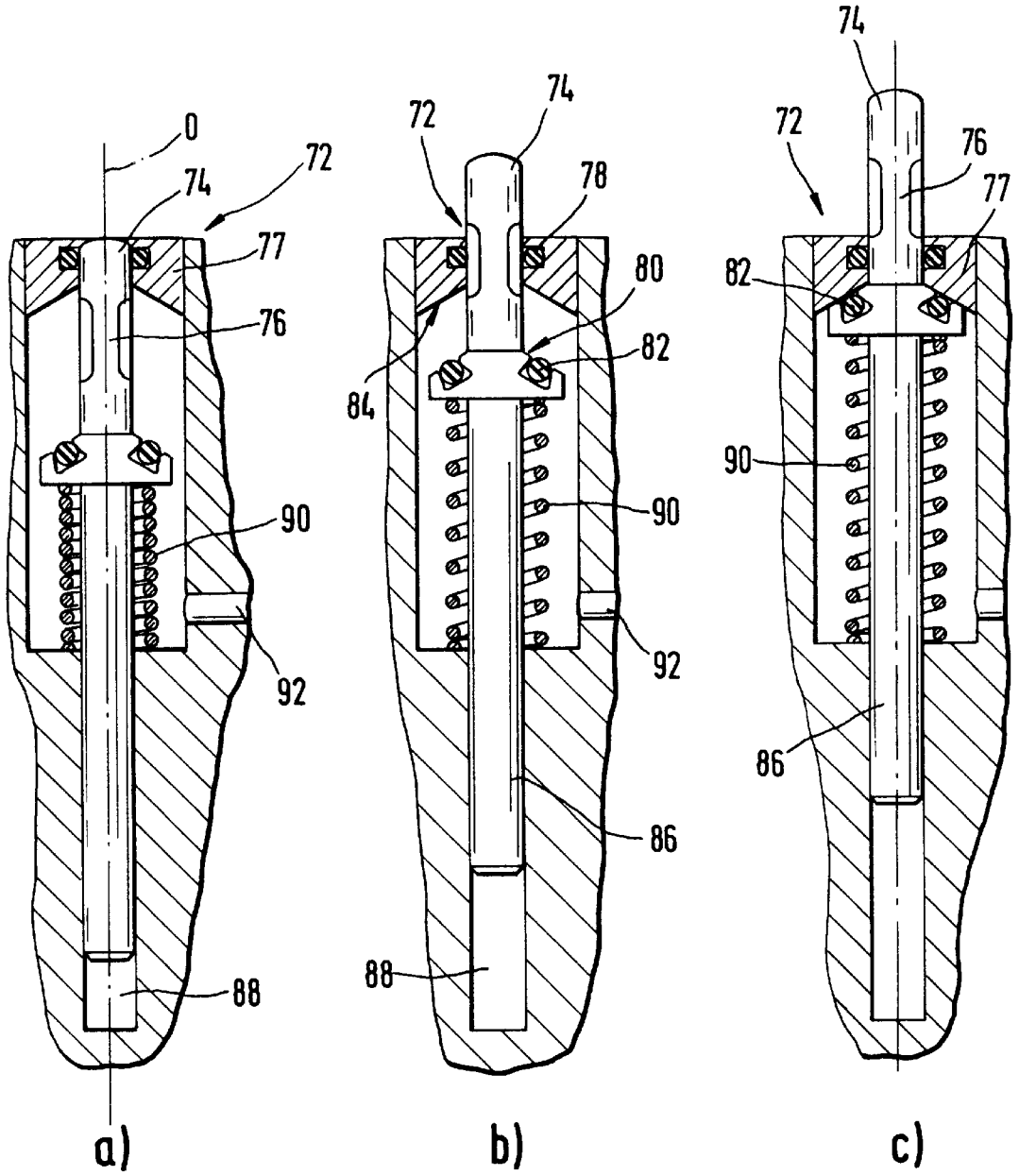
FIG. 7 is a vertical section through the central gas outlet of the coupling device in FIG. 5 at different positions of the closing element.

FIG. 7 shows the mode of operation of closing element 74. In it, the closing element is represented in three different positions. FIG. 7*c* (see also FIG. 5) shows the closing arrangement in an uncoupled state. The closing element 74 is pressed by the spring force of the helical spring 90 with its shoulder 80 tightly against the annular seating surface 84. The upper end of the closing element projects so far from the gas outlet 72 that the lower end section is level with the radial seal 78, whereby the gas outlet 72 is additionally sealed.

When the two parts of the coupling are brought together, the upper end of closing element 74 comes up against the central surface of dish 34 in the second part 12' of the coupling (this takes place before the remaining closing elements 64 come up against the second part 12' of the coupling), and the closing element 74 is partly pushed into the first part 10' of the coupling (FIG. 7*b*). The narrower middle section 76 of the closing element 74 comes to rest level with the radial seal 78, and the gas delivered through the connecting pipe 92 from an adjoining gas supply 54 can escape through the gap between the narrower middle section 76 of the closing element 74 and the radial seal 78. The gas is then deflected at the surface of the second part of the coupling and escapes radially outwards in all directions to take with it impurities which have been deposited on the surfaces of the two parts of the coupling, and the coupling surfaces are cleaned.

If the two parts of the coupling are now brought tightly together, the closing element 74 is completely pushed into the first part 10' of the coupling. In this position (FIG. 6 and FIG. 7*a*), the upper end section of the closing element 74 is level with the radial seal 78, so that the gas outlet 72 is again sealed off. No gas can thereby escape past closing element 74 in a coupled state, and this closure of gas inlet 72 is accomplished without having to fit an additional annular seal in the second part of the coupling, around the point of impact of the closing element 74.

Figure 8:
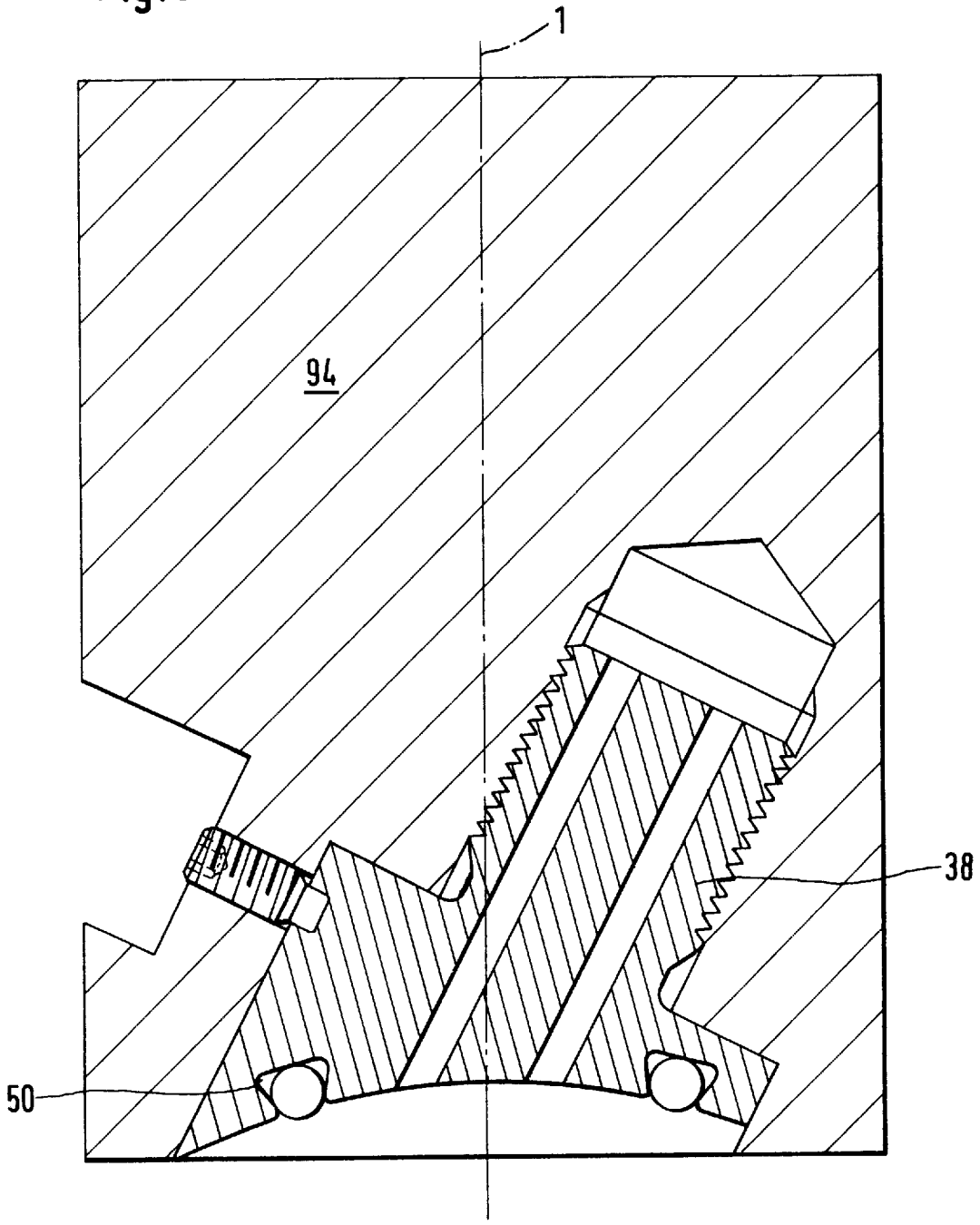
FIG. 8 is a section through a cylindrical fixture, with an insert screwed therein.

FIG. 8 shows a cylindrical fixture 94 with an insert 38 screwed into it. This cylindrical fixture 94 is necessary for the production of the insert. In fact, the production of the inserts constitutes a challenge, on account of their position outside the 0 axis of the device in the conical dish. Since the gas inlets are not arranged axially in the dish, the seals 48 are not in a plane perpendicular to the 0 axis, but are bent over the spherical surface of the rounded-off "bottom" of the dish. Thus swallow-tail groove 50 can not be turned in this position. For this reason, the following procedure is adopted for manufacture. First of all, insert blanks provided with an external thread are screwed into the coupling body 18 which has not yet been bored, and each one is secured against rotation by a pin inserted from the side through a hole in the coupling body. At the same time, its alignment is determined so that it can always be returned to the same position. The dish is then turned in the coupling body 18, wherein the inserts 38 receive their lower shape. Each insert 38 is then screwed out of the coupling body 18 and is screwed into the holder 94 at an angle to the holder axis 1, so that a middle plane through the groove 50 to be turned is perpendicular to the axis 1. The insert is then in turn secured against rotation by a pin, and the groove 50 can be turned in the underside of the insert by clamping the insert 38 together with the holder 94 in the lathe.

The coupling device according to the invention is, of course, not restricted to an embodiment with three gas inlets or outlets. Only two inlets could just as easily be provided, just as an embodiment with four or more inlets is within the scope of this invention.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Apparatus for the automatic coupling of a device to one or more gas pipes, comprising:

a first coupling part connected to a gas supply;

a second coupling part attached to the device;

a plurality of gas outlets in said first coupling part;

a plurality of gas inlets in said second coupling part;

a closing element in each of said gas outlets for closing and opening said gas outlets;

said closing element configured to be in a closed position to prevent gas flow when said first coupling part and said second coupling part are uncoupled;

said closing element configured to be moveable to an open position to permit gas flow when said first coupling part and said second coupling part are coupled; and said closing element in one of said gas outlets configured to be moveable to its open position to initiate the flow of gas therefrom before the other closing elements are moved to their respective open positions.

2. Apparatus for automatic coupling as in claim 1, wherein:

there is one gas outlet more in said first coupling part than gas inlets in said second coupling part; and wherein the closing element of said one more gas outlet is opened before the closing element of said other gas outlets are opened.

3. Apparatus for automatic coupling, as in claim 2 wherein:

the coupling apparatus has an axis; and said one more gas outlet is on the axis of the coupling apparatus.

4. Apparatus for automatic coupling, as in claim 1 wherein:

each of said gas outlets is conical; and each of said closing elements is conical;

each of said closing element being displaceable in the first coupling part and, in the closed position projecting from its respective conical gas outlet, whereby when coupling takes place each closing element is pressed inwards into the first coupling part by the second coupling part.

5. Apparatus for automatic coupling, as in claim 4 including:

elastic means associated with each closing element to urge the closing element tightly against its conical gas outlet when the coupling device is uncoupled;

each of said conical closing elements being displaceable in its corresponding conical gas outlet against the elastic means.

6. Apparatus for automatic coupling, as in claim 5, wherein:

said elastic means comprises a helical spring.

7. Apparatus for automatic coupling, as in claim 4 wherein:

each of said conical closing elements has an annular shoulder surface in which an annular seal is located; and an annular seating surface surrounding each conical gas outlet;

said annular seal tightly contacting said annular seating surface when the conical closing element is positively seated in the conical gas outlet.

8. Apparatus for automatic coupling as in claim 1 wherein:

said first part of the coupling is in the form of a cone, and said second part of the coupling is in the form of an inverted conical dish which can be pushed onto said cone, the opening angle of said dish being greater than the opening angle of said cone of the first part of the coupling.

9. Apparatus for automatic coupling as in claim 8 wherein:

said cone of the first part of the coupling has a spherical tip, and the bottom of said inverted conical dish of the second part of the coupling is spherical, said spherical tip of the first part of the coupling and said spherical bottom of the dish being concentric and mating when said first and second coupling parts are coupled.

10. Apparatus for automatic coupling as in claim 9, wherein:

said gas outlets are arranged in said spherical tip of said first coupling part and said gas inlets are arranged in said spherical dish in said second coupling part.

11. Apparatus for automatic coupling as in claim 1 wherein:

said second coupling part includes a coupling sleeve and a coupling body;

said coupling body being displaceable in said coupling sleeve, and further including:

elastic means urging said coupling body toward a first position in said coupling sleeve;

whereby, when the coupling apparatus is uncoupled, the coupling body is in an advanced position, and, when the coupling apparatus is coupled together, the coupling body is pressed into the coupling sleeve against the force for said elastic means, so that said coupling body is pressed tightly against the surface of said first coupling part by the force of said elastic means.

12. Apparatus for automatic coupling as in claim 11, wherein:

said second coupling part includes a chamber above said coupling body;

one of the gas inlets in the second coupling part being connected to said chamber above the coupling body whereby, when the coupling apparatus is coupled together, the gas pressure generated in said chamber exerts a force on said coupling body to increase the contact pressure between said first and second coupling parts.

13. Apparatus for automatic coupling as in claim 11 wherein:

said elastic means comprises a helical spring.

14. Apparatus for automatic coupling as in claim 1 wherein:

each gas inlet is an insert which can be screwed into the second coupling part.

15. Apparatus for automatic coupling as in claim 14 including:

a turned groove in each screw-in insert; and an annular seal in each of said grooves.

16. Apparatus for automatic coupling as in claim 14 wherein:

each insert includes several passages, arranged in a circle around the point of impact of the corresponding closing element.

17. Apparatus for automatic coupling as in claim 2 wherein:

said one more gas outlet has an associated closing element axially displaceable in said one more gas outlet, whereby said gas outlet is open during the coupling process, and gas outlet is closed when the coupling apparatus is completely uncoupled or completely coupled together.

18. Apparatus for automatic coupling as in claim 17 wherein:

said associated closing element projects from said first coupling part in the closed position of said associated closing element, said associated closing element being moved inwards into said first coupling part by said second coupling part when said first and second coupling parts are coupled together.

19. Apparatus for automatic coupling as in claim 17, including:

an insert having an axial bore positioned in said one more gas outlet; and said closing element of one more gas outlet being cylindrical and having two end sections and a narrower middle section, the diameter of said axial bore in said insert being such that said cylindrical end sections of said closing element can be displaced in said axial bore with a precise fit.

20. Apparatus for automatic coupling as in claim 19, including:

a radial seal on said insert, whereby said one more gas outlet is sealed by the closing element when said closing element is in a position in which one of the two end sections is in contact with said radial seal, and said one more gas outlet is open when said closing element is in a position in which the narrower middle section of said closing element is opposite to said radial seal.

21. Apparatus for automatic coupling as in claim 19, including:

an annular shoulder surface on said cylindrical closing element; and an annular seal in said shoulder surface, said annular seal being tightly against an annular seating surface surrounding said axial bore on said insert when the cylindrical closing element projects maximumly out of the said one more gas outlet.

22. Apparatus for automatic coupling as in claim 21, wherein:

said cylindrical closing element is axially displaceable in said one more gas outlet against an elastic means; and wherein the elastic means, when the coupling apparatus is uncoupled, displaces said cylindrical closing element in said gas outlet so that said annular shoulder surface is pressed tightly against said annular seating surface of said insert.

23. Apparatus for automatic coupling as in claim 22 wherein:

said elastic means comprises a helical spring.

24. Apparatus for automatic coupling as in claim 17, wherein:

said one more gas outlet is connected via a connecting pipe to the gas supply of another gas outlet.

25. A method for the automatic coupling of a device to several gas pipes, wherein a first coupling part connected to a gas supply and a second coupling part attached to the device are coupled together, and wherein a plurality of closeable gas outlets are arranged in the first coupling part and a plurality of gas inlets are arranged in the second coupling part, including the steps of:

a) moving at least one of said first and second coupling parts toward the other;

b) opening a first gas outlet in said first coupling part before the first and second coupling parts are brought together;

c) opening of the remaining gas outlets in said first coupling part after the coupling surfaces have been cleaned by the gas flowing from the open first gas outlet, wherein impurities which have been deposited on the coupling surfaces are flushed radially outwards by the gas flow;

d) effecting a coupling of said first and second coupling parts;

e) effecting sealing of the individual transitions between the respective gas outlets and the corresponding gas inlets.

* * * * *